US011517128B1

(12) United States Patent
Nieto

(10) Patent No.: US 11,517,128 B1
(45) Date of Patent: Dec. 6, 2022

(54) SYSTEM AND METHOD FOR A GRAZING WALL FOR FOOD AND BEVERAGES

(71) Applicant: Aimee Nieto, Jacksonville Beach, FL (US)

(72) Inventor: Aimee Nieto, Jacksonville Beach, FL (US)

( * ) Notice: Subject to any disclaimer, the term of this patent is extended or adjusted under 35 U.S.C. 154(b) by 0 days.

(21) Appl. No.: 17/561,148

(22) Filed: Dec. 23, 2021

(51) Int. Cl.
*A47F 5/08* (2006.01)
*A47B 87/02* (2006.01)
(Continued)

(52) U.S. Cl.
CPC ..... *A47F 5/083* (2013.01); *A47B 45/00* (2013.01); *A47B 47/0091* (2013.01); *A47B 87/0207* (2013.01); *A47F 5/0876* (2013.01); *A47F 5/103* (2013.01); *A47F 11/02* (2013.01); *A47B 2096/209* (2013.01); *A47F 2005/0075* (2013.01)

(58) Field of Classification Search
CPC ..... A47F 5/083; A47F 5/0876; A47F 7/0071; A47F 5/0018; A47F 5/0043; A47F 5/0884; A47F 5/10; A47F 5/105; A47F 7/0021; A47F 7/0028; A47F 11/02; A47F 10/06; A47F 5/103; A47F 2005/0075; A47F 5/0068; A47B 87/0207; A47B 87/0215; A47B 75/00; A47B 47/0091; A47B 87/007; A47B 87/02; A47B 45/00; A47B 47/00; A47B 47/022; A47B 47/047; A47B 47/05; A47G 23/0641; A47G 23/065; A47G 2400/06; A47G 2096/209; A47G 5/00; E04B 2002/7483; E04B 2/7401
USPC ..... 211/85.4, 90.01, 90.02, 90.04, 103, 188, 211/194, 181.1, DIG. 1, 70.8, 62, 63, 211/66–68, 75, 88.01, 13.1; 160/352, 351
See application file for complete search history.

(56) References Cited

U.S. PATENT DOCUMENTS 3,101,681 A * 8/1963 Streater ..... A47B 57/425 211/187
3,199,471 A * 8/1965 Orsi ..... F16B 12/50 211/187
(Continued)

OTHER PUBLICATIONS https://www.etsy.com/listing/1085600083/champagne-wall-rental-nj-area?click_key=2b6136971c6f0fb4a79eddf52f841c4be99ee720%3A1085600083&click_sum=1b5d51fc. Date: Nov. 11, 2021 (see top left of p. 1). (Year: 2021).*
(Continued)

*Primary Examiner* — Jennifer E. Novosad
(74) *Attorney, Agent, or Firm* — Houda El-Jarrah; Bold IP, PLLC

(57) ABSTRACT

A grazing wall that includes several shelves configured to hold several containers of food or drink. The grazing wall is aesthetically unique and pleasing with either decorative cover panels or decorative greenery, flowers, or plants arranged to cover a back structure of the grazing wall. The containers of the food or drink are aesthetically appealing and can be in the form of cones or drinking glasses, whereby the containers of food or drink can be removed from each individual slot included in the multiple slots on each shelf. The grazing wall can further include a base and a top finishing piece. The grazing wall can have adjustable heights depending on the number of modules connected in a vertical orientation to form the grazing wall. The grazing wall can include cover panels configured to removably attach to a set of grid panels.

20 Claims, 14 Drawing Sheets

(51) Int. Cl.

| | |
|---|---|
| ***A47F 11/02*** | (2006.01) |
| ***A47B 45/00*** | (2006.01) |
| ***A47F 5/10*** | (2006.01) |
| ***A47B 47/00*** | (2006.01) |
| ***A47B 96/20*** | (2006.01) |
| ***A47F 5/00*** | (2006.01) |

(56) References Cited

U.S. PATENT DOCUMENTS 3,200,775 A * 8/1965 Peters ..... A47B 57/52 108/108
3,394,507 A * 7/1968 Doke ..... E04B 2/7854 52/363
3,602,159 A * 8/1971 Marschak ..... A47F 5/103 211/187
3,640,389 A * 2/1972 Snyder ..... A47F 5/0093 211/187
3,886,698 A * 6/1975 Raith ..... A47B 57/404 211/126.16
4,415,091 A * 11/1983 Wolff ..... A47F 5/0846 248/220.21
4,508,300 A * 4/1985 Minick ..... E04B 2/7425 248/216.1
4,542,832 A * 9/1985 Minick ..... A47B 55/02 211/181.1
4,784,205 A * 11/1988 Johnson ..... A47G 5/00 160/351
5,031,683 A * 7/1991 Marvy ..... G09F 7/00 248/167
5,303,830 A * 4/1994 Metcalf ..... A47F 5/0807 211/208
5,313,891 A * 5/1994 Suttles ..... A47B 47/022 211/186
5,415,301 A * 5/1995 Bruton ..... A47B 96/1416 211/183
5,509,541 A * 4/1996 Merl ..... A47B 57/42 211/208
5,526,941 A * 6/1996 Ford ..... A47F 5/0869 211/60.1
5,570,540 A * 11/1996 Womack ..... A47G 7/041 47/60
5,588,543 A * 12/1996 Finger ..... A47F 5/083 211/90.01
5,755,343 A * 5/1998 Harvey, Sr. ..... A47F 7/0078 211/90.01
5,769,248 A * 6/1998 Johnson ..... A47F 5/0807 248/220.21
5,785,190 A * 7/1998 Otema ..... A47F 5/0823 248/221.12
5,884,784 A * 3/1999 Betts, Sr. ..... B01L 9/00 248/905
5,897,003 A * 4/1999 Muhlack ..... A47F 5/083 211/75
6,062,399 A * 5/2000 Henry ..... A47F 5/0815 211/189
6,062,402 A * 5/2000 Ford ..... A47F 5/083 211/181.1
6,179,135 B1 * 1/2001 Simpson ..... G10G 5/00 211/DIG. 1
6,193,083 B1 * 2/2001 Wood ..... G09F 15/0068 211/90.04
6,264,220 B1 * 7/2001 Pierce ..... B25H 3/04 280/47.35
6,318,569 B1 * 11/2001 Rothing ..... F16B 12/00 211/DIG. 1
6,712,229 B2 * 3/2004 Fritsche ..... A47F 5/105 211/207
6,786,340 B2 * 9/2004 Ford ..... A47F 5/0823 211/103
6,915,916 B2 * 7/2005 Martins ..... A47F 5/0018 211/186
6,918,499 B2 * 7/2005 De Land ..... A47F 5/0018 211/187
6,942,110 B2 * 9/2005 Martins ..... A47F 5/01 211/59.1
7,270,242 B2 * 9/2007 Liu ..... A47B 47/024 248/188.8
7,387,213 B1 * 6/2008 Smalley ..... A47F 5/101 211/106
7,798,338 B2 * 9/2010 Maheu ..... A47F 5/0815 211/94.02
7,861,888 B2 1/2011 Niedzwiecki
7,950,536 B2 * 5/2011 Arradondo ..... A47F 5/103 248/220.21
8,511,488 B2 * 8/2013 Poisson ..... A47B 96/021 211/183
8,967,402 B2 * 3/2015 Pintur ..... A47F 5/0018 211/DIG. 1
9,468,312 B2 * 10/2016 Denby ..... A47F 5/108
10,413,056 B2 * 9/2019 Green ..... A47B 57/562
10,448,755 B1 * 10/2019 McDowell ..... A47F 5/0018
10,672,302 B1 * 6/2020 Schultz ..... A47F 5/0846
2002/0095890 A1 * 7/2002 Brauning ..... A47F 5/105 52/239
2004/0084392 A1 * 5/2004 Richter ..... A47F 5/0838 211/59.3
2005/0199568 A1 * 9/2005 Gay ..... A47F 5/00 211/187
2006/0043038 A1 * 3/2006 Wetzel ..... A47F 7/0078 211/88.03
2007/0023376 A1 * 2/2007 Black ..... A47B 47/025 211/187
2007/0251426 A1 * 11/2007 Li ..... A47B 87/0246 108/27
2010/0038040 A1 * 2/2010 Korov ..... A47G 5/00 160/130
2010/0300995 A1 * 12/2010 Huang ..... A47G 23/0208 211/60.1
2011/0024376 A1 * 2/2011 Hendricks ..... A47H 1/12 292/259 R
2011/0192812 A1 * 8/2011 Weigand ..... A47F 5/10 211/85.8
2014/0001131 A1 * 1/2014 Johnson ..... A47F 5/0025 211/206
2014/0054252 A1 * 2/2014 Woodley ..... A47F 11/02 211/183
2015/0060379 A1 * 3/2015 Larson ..... A47G 29/08 211/88.01
2015/0289650 A1 * 10/2015 Yau ..... A47F 5/0068 29/434

OTHER PUBLICATIONS

Modern DIY Bride, greenweddingshoes.com, https://greenweddingshoes.com/modern-diy-bride-norcal-wedding/?utm_medium=referral&utm_source=pinterest&utm_campaign=dhpinterest, date accessed: Dec. 23, 2021.
My bleu events, myblueevents.com, https://mybleuevents.com/wp-content/uploads/2018/01/BMW-Catering-2.jpg, date accessed: Dec. 23, 2021.
Carolyn Sweets, www.carolynssweets.ie, https://www.carolynssweets.ie/ngg_tag/donut-wall-hire/, date accessed: Dec. 23, 2021.
Easyylivin, www.easyylivin.com, https://www.easyylivin.com/products/cones, date accessed: Dec. 23, 2021.
Paper Petal Cones, www.pinterest.com, https://www.pinterest.com/pin/350577152247069199/, date accessed: Dec. 23, 2021.
East of Ellie, www.pinterest.com, https://www.pinterest.com/pin/11329436551158876/, date accessed: Dec. 23, 2021.
Kaiserchote Catering, www.kaiserschote.de, https://www.kaiserschote.de/privat-start.html, date accessed: Dec. 23, 2021.

* cited by examiner

SYSTEM AND METHOD FOR A GRAZING WALL FOR FOOD AND BEVERAGES

FIELD OF THE DISCLOSURE

The present invention relates to a grazing wall that may be used to display and present containers of items, in particular food and/or beverages, that may be useful at an event. In particular, the grazing wall may be particularly suited to housing and displaying in an aesthetically appealing manner individual containers, including, but not limited to, cones or drinking glasses that include a variety of foods, snacks, and/or drinks or other items.

BACKGROUND

The use of tables to present food, including snacks, and/or beverages is well known. Tablecloths and/or butcher paper may be used to cover the tables and then various snacks and dishes may be laid over the table. However, because tables are a horizontal, structural items, they often end up taking a great deal of space, in particular if there are multiple tables needed, such as may be the case at an event with a large number of people.

Accordingly, there is a need for an improved structure that can display food and drink items that maximizes on the vertical space available in a location and may be particularly memorable at a function or an event.

SUMMARY

According to one embodiment, one or more embodiments are provided below for a grazing wall having a set of back panels, a set of cover panels configured to removably attach to the set of back panels, and a set of shelves configured to removably attach to the set of cover panels. The set of shelves may further comprise multiple slots, whereby the set of multiple slots are spaced apart from one another and separated by separate segments in between each slot of the multiple slots. The set of multiple slots may be configured to hold containers for food or drinks. In a non-limiting embodiment, the set of back panels comprise a set of grid panels, whereby each grid panel is modular and further comprises horizontal grid bars and vertical grid bars.

In a non-limiting embodiment, each cover panel of the set of cover panels may comprise a front side and a back side. In a non-limiting embodiment, the front side of each cover panel may include a decorative appearance and the back side of each cover panel may include one or more attachment mechanisms to removeably attach each cover panel to each grid panel. In a non-limiting embodiment, each cover panel may include a clip that clips into or onto the grid bars and/or spaces in between each grid bar of the back panel modules. Further, each cover panel may include a set of magnets that can also magnetically attach to the back panel module in addition to the attachment mechanisms provided by the clips.

In a non-limiting embodiment, the set of shelves may be magnetically connectable and removably connectable to the set of cover panels, which in turn may be magnetically connectable and removably connectable to the set of back panels. In a non-limiting embodiment, a height of the grazing wall is determined by a number of the set of back panels and the set of cover panels connected vertically to each other, wherein the height of the grazing wall is alterable depending on the number of the set of back panels and the set of cover panels that are connected vertically to each other. In a non-limiting embodiment, connectors are used to connect the set of back panels together in a vertical orientation.

Further, the set of cover panels may include a decorative or aesthetically appealing front side. In a non-limiting embodiment, greenery or foliage is configured to drape over or to be attached to one or more cover panels of the set of cover panels. Further, in a non-limiting embodiment, the grazing wall may further comprise a detachable base piece, whereby a first back panel of the set of back panels is configured to attach to the detachable base piece and offer structural support to the grazing wall. In another non-limiting embodiment, the grazing wall may include a top finishing or head piece that is configured to attach to an uppermost back panel of the grazing wall, whereby either the top head piece or the detachable base piece may include decorative text, images, or any other kind of decorative elements.

Other aspects and advantages of the invention will be apparent from the following description and the appended claims.

BRIEF DESCRIPTION OF THE DRAWINGS

Embodiments of the present disclosure are described in detail below with reference to the following drawings. These and other features, aspects, and advantages of the present disclosure will become better understood with regard to the following description, appended claims, and accompanying drawings. The drawings described herein are for illustrative purposes only of selected embodiments and not all possible implementations and are not intended to limit the scope of the present disclosure.

DETAILED DESCRIPTION

Figure 1:
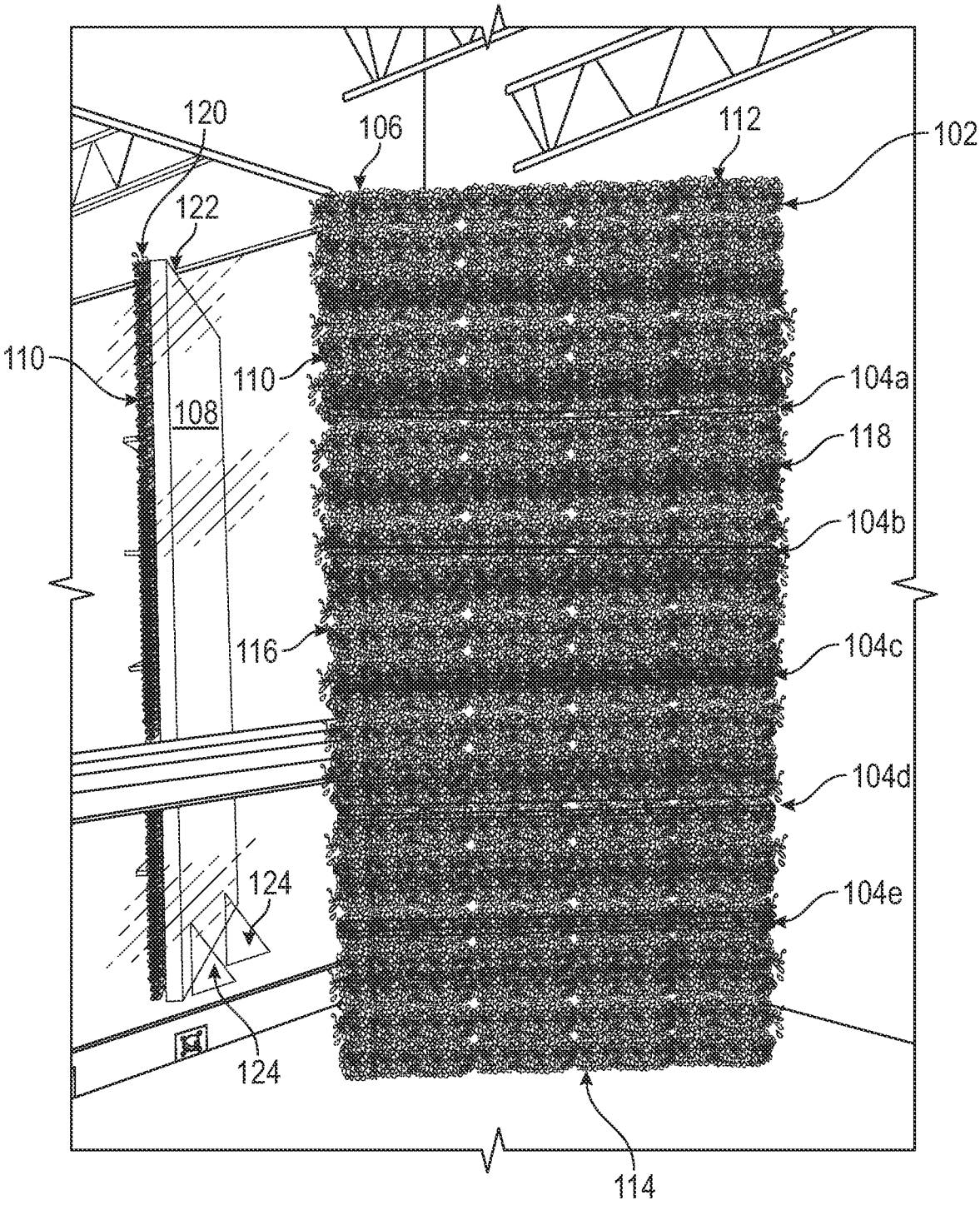
FIG. 1 is a pictorial illustration of an exemplary grazing wall.

In the Summary above and in this Detailed Description, and the claims below, and in the accompanying drawings, reference is made to particular features (including method steps) of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with and/or in the context of other particular aspects and embodiments of the invention, and in the invention generally.

The term "comprises" and grammatical equivalents thereof are used herein to mean that other components, ingredients, and steps, among others, are optionally present. For example, an article "comprising" (or "which comprises") components A, B, and C can consist of (i.e., contain only) components A, B, and C, or can contain not only components A, B, and C but also contain one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

The term "at least" followed by a number is used herein to denote the start of a range beginning with that number (which may be a range having an upper limit or no upper limit, depending on the variable being defined). For example, "at least 1" means 1 or more than 1. The term "at most" followed by a number is used herein to denote the end of a range ending with that number (which may be a range having 1 or 0 as its lower limit, or a range having no lower limit, depending upon the variable being defined). For example, "at most 4" means 4 or less than 4, and "at most 40%" means 40% or less than 40%. When, in this specification, a range is given as "(a first number) to (a second number)" or "(a first number)–(a second number)," this means a range whose lower limit is the first number and whose upper limit is the second number. For example, 25 to 100 mm means a range whose lower limit is 25 mm and upper limit is 100 mm.

Certain terminology and derivations thereof may be used in the following description for convenience in reference only and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

The term "coupled to" as used herein may mean a direct or indirect connection via one or more components. The term "set" may mean one item or a plurality of items.

The present disclosure is generally drawn to various embodiments for a grazing wall configured to hold individual containers that are accessible from shelves on the grazing wall. The individual containers may be designated for holding food and/or snack items or for holding beverages. In one or more non-limiting embodiments, the grazing wall may be assembled to a desired height by the user and/or manufacturer. The grazing wall may be modular and may be built in sections to the desired height in one or more non-limiting embodiments. Further, the grazing wall may be taken apart and stored when not in use so that minimum storage space is required to store the grazing wall. Further, the grazing wall may include a variety of cover panels having a variety of exterior appearances to offer a decorative and aesthetically appealing look to the grazing wall, including, but not limited to, cover panels that include faux marble paneling, faux greenery or other natural elements such as vines and/or flowers, velvet paneling, or any other type of material covering the cover panel. Further details are provided with respect to the Figures described below.

Figure 2:
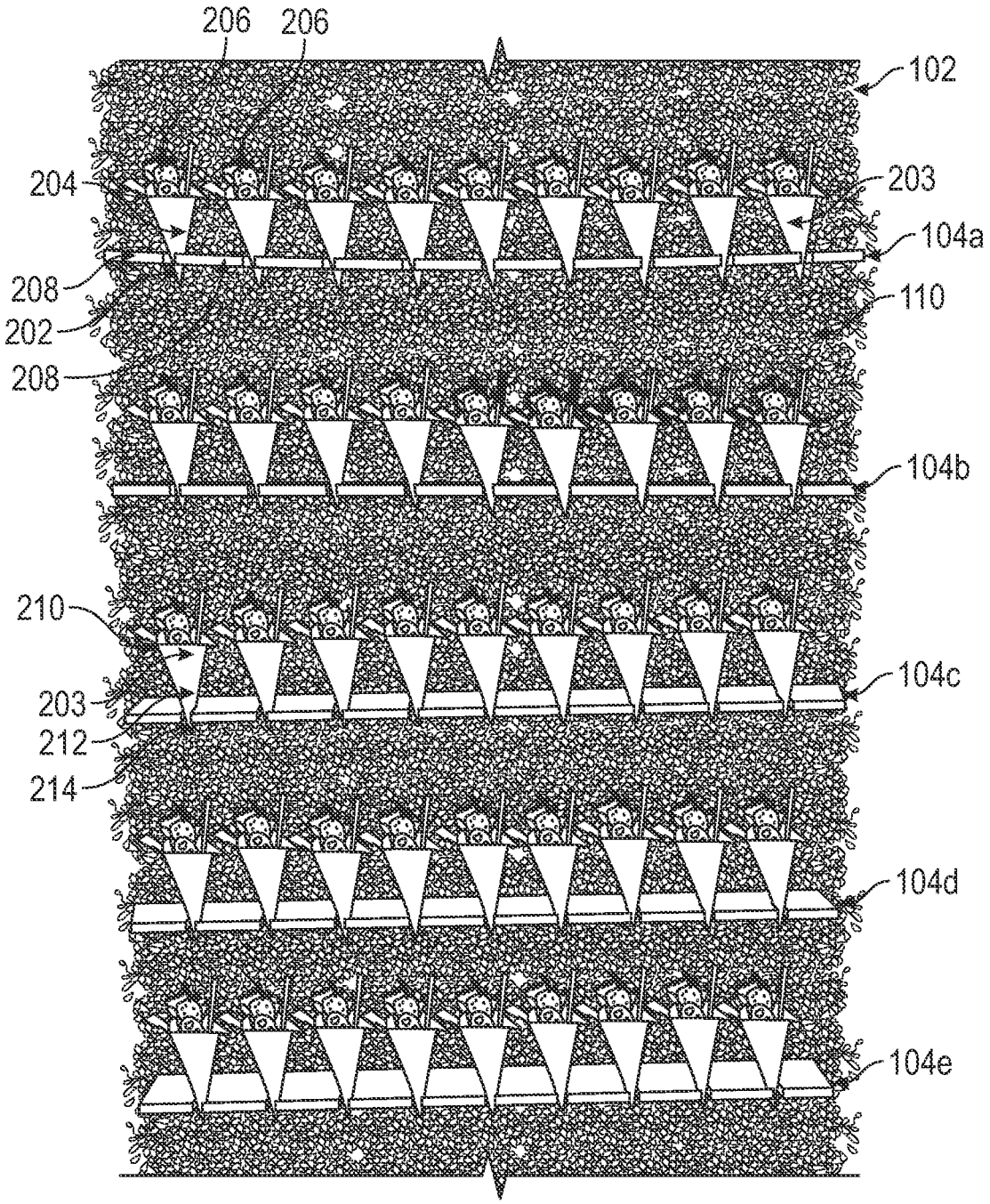
FIG. 2 is a pictorial illustration of an exemplary grazing wall with multiple shelves and decorative containers of food and/or drinks and/or other items on the shelves of the grazing wall.
Figure 3:
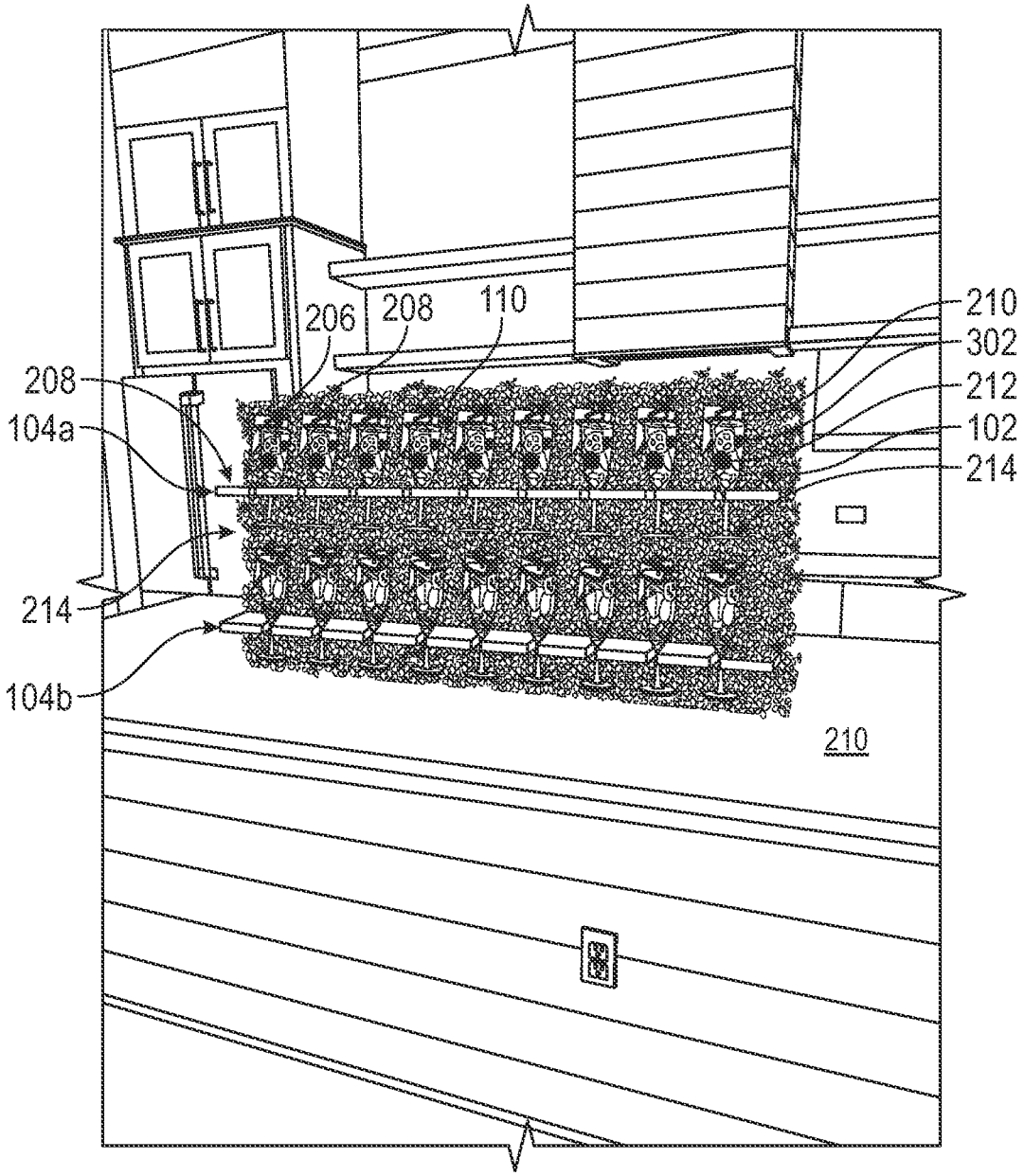
FIG. 3 is a pictorial illustration of a grazing wall at a shorter height and smaller size.

FIG. 1 depicts an exemplary grazing wall 102. Grazing walls 102 as used herein may refer to a wall structure having dedicated spaces on the grazing wall 102 for containers of food or beverages, such as containers 203 shown in FIG. 2 that guests or other users at a party, celebration, or any type of event can retrieve from the dedicated spaces on the grazing wall 102. The grazing wall 102 is intended to be both functional and decorative and maximize vertical space to display containers 203 having various contents 206. As shown in FIG. 2 and FIG. 3, the containers 203 include edible contents 206. Accordingly, in one or more non-limiting embodiments, the containers 203 may hold and contain edible items such as food and/or beverage. In other embodiments, the containers 203 may hold non-edible items mixed in with edible contents 206 or solely hold non-edible contents 206. Advantageously, rather, than having multiple tables that take up a great deal of horizontal space in a room or other type of setting, the grazing wall 102 can still hold multiple levels of shelves of containers 203 of various content 206 types and capitalize on using the vertical space of a setting to display and present the grazing wall 102.

Grazing wall 102 as shown in FIG. 1-3 is a basic embodiment that depicts how the grazing wall 102 may look and function according to one or more non-limiting embodiments. As shown in FIG. 1, the main frame wall structure 122 may have a front surface 104, a back surface 108, top edge 112, bottom edge 114, left side 116, and a right side 118. As shown in FIG. 1, the grazing wall 102 may include a main wall structure 122. In a n non-limiting embodiment, the main frame wall structure 122 may include one or more feet 124 at the base or bottom 114 of the main wall structure 122 to help support and anchor the main frame wall structure 122. In a non-limiting embodiment, the grazing wall 102 may be a self-standing and self-supporting structure via the user of feet 124 or another base structure (e.g., base structure 412 shown in FIG. 4) that does not require the grazing wall 102 to be attached to a ground surface or other vertical surface to stand upright.

The main frame wall structure 122 may be an upright support structure having a predetermined thickness to support the weight of multiple shelves, such as shelves **104*a*-104*e* shown in FIG. 2 and FIG. 3. The main frame wall structure 122 may be built as a single integrated unit or may be broken up into smaller segments and modules (e.g., as shown in FIG. 3) so that the user can determine what height the grazing wall 102 may be. As shown in FIG. 3, the grazing wall 102 may be a smaller segment or module of one or more shelves 104*a*, 104*b*, etc. to hold the desired number of containers 203** of food or beverages to suit the user and/or the occasion.

In some instances, the grazing wall 102 may be a self-standing structure that may stand on its own in a vertical space on a ground surface. In other instances, the grazing wall 102 may be a self-standing structure that may be placed on a table surface or other elevated surface without requiring other attachment mechanisms to attach to the table surface, as shown in FIG. 3. As shown in FIG. 1, the grazing wall 102 may incorporate one or more feet 124 elements that support a lower section/module or area of the grazing wall 102. The use of the feet 124 or other base structure may be useful to keep the grazing wall 102 upright and supported on any support surface, whether the support surface is a ground surface or a table surface.

Uniquely, the grazing wall 102 is configured to support one or more shelves 104*a*-104*e* or as many as required. A greater or lesser number of shelves 104 may be utilized other than as shown in FIGS. 1-3. The height of the grazing wall 102 may be customized to range from a very short wall to a very tall wall as needed by the space and use considerations.

1. As shown in FIG. 2, the shelves 104 include dedicated containers 203 that can hold any type of food or beverages in a convenient and easy to reach manner for guests or other users where the grazing wall 102 is located. An intended use of the grazing wall 102, according to one or more non-limiting embodiments, may be that the grazing wall 102 may be set up so that guests or other users can independently walk up and retrieve the containers 203 of pre-filled and assembled food or beverages from the grazing wall 102 or be handed the containers 203 of pre-filled and pre-assembled food or beverages by another person. In a non-limiting embodiment, the set of containers 203 are positioned ahead of and in advance of a front side of the grazing wall and do not touch a front side of the grazing wall 102.

The containers 203 of the grazing wall 102 fit within the dedicated slots 202 integrated into each shelf 104 as shown in FIG. 2 and FIG. 3. There may be multiple slots 202, for each shelf 104 is spaced apart by separate segments 208. In a non-limiting embodiment, the containers 203 may be in the form of cones 204, as shown in FIG. 2, or may be in the form of drinking glasses 302 as shown in FIG. 3. FIG. 2 shows multiple shelves 104 having multiple containers 203 in the form of cones 204 positioned in each slot 202 on each shelf 104*a*-104*e*. In a non-limiting embodiment, there are at least nine slots 202 on each shelf 104, although one of ordinary skill will understand there may be more or less slots 202 on each shelf 104. FIG. 3 shows multiple containers 203 in the form of drinking glasses 302 positioned in each slot 202 on each shelf 104*a*-104*b* and the grazing wall 102 being free standing and supported on a table surface.

Notably, in a non-limiting embodiment, the containers 203 may preferably have an open top 210, as shown by the cones 204 and the drinking glasses 302 so that the containers 203 can be filled with food or beverages and the user can easily access the contents of the containers 203 from the open top 210 of each container 203. As shown in FIG. 2 and FIG. 3, a majority of the body 212 of the container 203 may rest above the slot 202 in between each separate segment 208 of each shelf 104, and a bottom portion 214 of the containers 203 may extend beneath the slots 202 of the shelves 104. As shown in FIG. 2, the end pointed tip of the cone container 204 may be positioned or extend beneath the slot 202 of each shelf 104 while the bottom stems of the drinking glasses 302, as shown in FIG. 3, may be positioned or extend beneath the slots 202 of each shelf 104. In some embodiments, the types of containers 203 included on each shelf 104 of the grazing wall 102 may be uniform, such that, all the containers 203 may be the same type of container 203. In other cases, the types of containers 203 may be varied such that both cones 204 and drinking glasses 302 or other types of containers 203 may be utilized and displayed on a same grazing wall 102.

In a non-limiting embodiment, the cone containers 204 may be made of paper or other recyclable material, although any other type of material may be utilized, including non-paper materials. The drinking glasses 302 may be in the form of champagne glasses in one or more non-limiting embodiments, and may be made of plastic, glass, or any other type of material known in the art. The drinking glasses 302 may be transparent such that the contents 206 (e.g., food and/or beverages or any other contents) of the drinking glasses 302 may be visible when looking directly at the grazing wall 102.

Notably, one of the decorative aspects of the grazing wall 102 may be that the contents 206 of the containers 203 may either protrude above the open top 210 of each container 203 to indicate to the user from afar what is contained within the container 203. Alternatively, or additionally, the container 203 may be transparent and/or see through such that the user can see the contents 206 of the container 203 from afar as displayed within each slot 202 on each shelf 104 of the grazing wall 102.

In a non-limiting embodiment, there may be a variety of food items included in a container 203, including, but not limited to, cheese, fruit, vegetables, snack items, or any other type of edible food items or non-edible items without limitation. In other non-limiting embodiments, the food items may be the same type contained in the one or more containers 203 displayed and presented on the grazing wall 102. Further, the containers 203 can hold beverages for easy access by a guest or other user to retrieve from the dedicated slots 202 integrated into each shelf 104 of the grazing wall 102. The display of the containers 203 (e.g., in the form of cones 204 or drinking glasses 302) to hold the contents 206 within the containers 203 provides a means for enclosing a specific assembly of food items, including sweets, salty treats, meats, cheeses, fruits, vegetables, or any other type of food items, in an organized and pre-arranged manner. The display of the contents 206 within the containers 203 may be more decorative and visually appealing when displayed on the shelves 104 of the grazing wall 102 in each dedicated slot 202 as shown in FIG. 1-3 than traditional forms of presentation and display that involve presenting larger platters or bowls of food items or drink containers on a table or other surface. The grazing wall 102 as shown in FIGS. 1-3 may be particularly appealing and add a unique aspect to celebratory events such as birthdays, weddings, bridal showers, baby showers, or any other type of event without limitation thereto.

Figure 11:
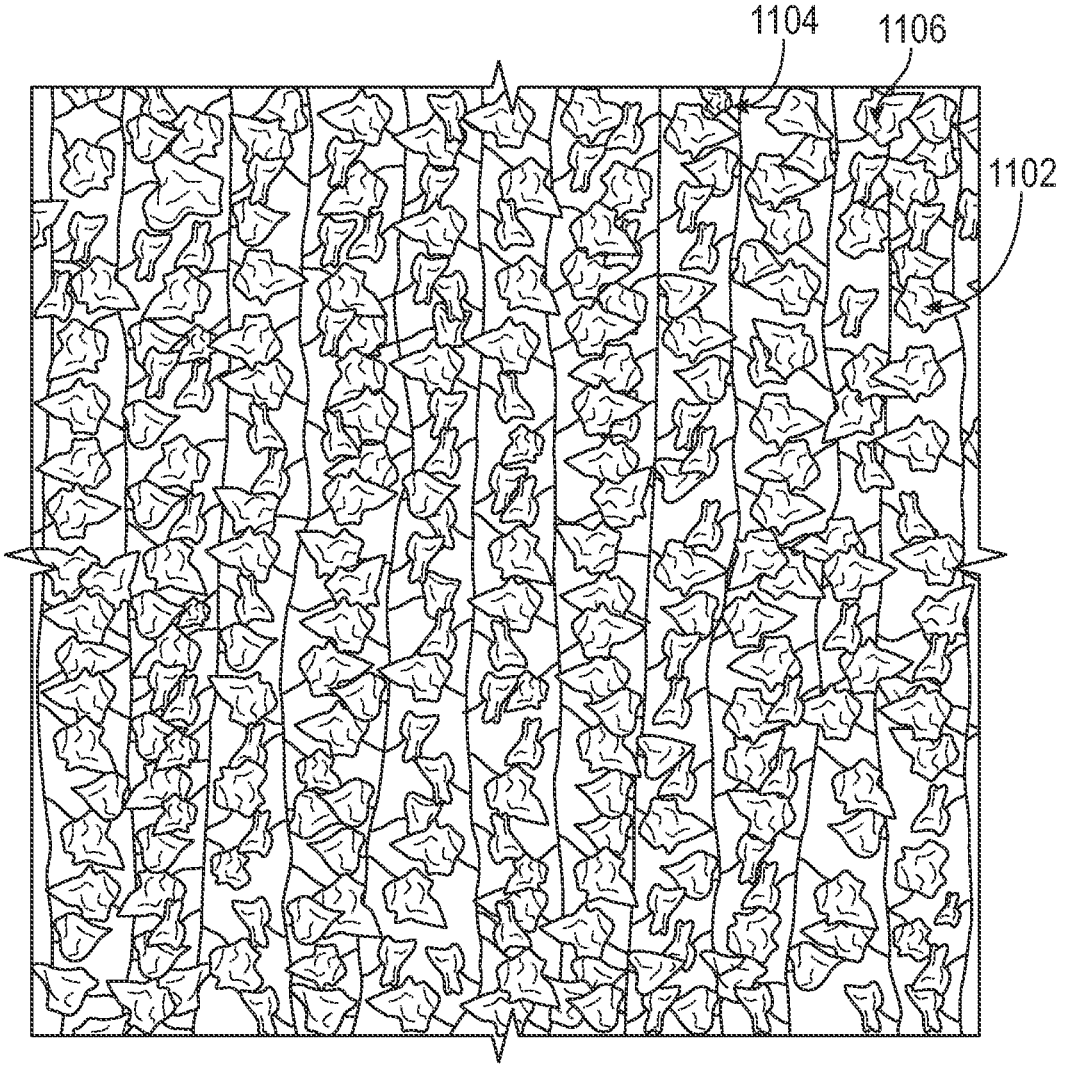
FIG. 11 is a pictorial illustration of greenery that can cover a grazing wall.

As shown in FIG. 1-3, there may be decorative greenery covering 110 covering a front surface 106 of the grazing wall 102 for an aesthetically pleasing visual effect. The greenery covering 110 can be artificial and synthetic (e.g. faux), and/or incorporate real and live elements in one or more non-limiting embodiments. The greenery covering 110 may be attached to a front side of the grazing wall 102 and/or drape in front of the grazing wall 102. The greenery covering 110 may include vines, leaves, flowers, fruits, vegetables, moss, or any other kind of element found in nature. The greenery covering 110 may further include beads, shells, streamers, or any other decorative elements. The greenery covering 110 and the term greenery covering as used herein including greenery covering 1102 shown in FIG. 11 is not limited to real or faux greenery. The term "greenery covering" may include real or faux, synthetic decorative elements of any kind. The greenery covering 110 can be very dense or can be lighter in appearance and density in one or more embodiments.

As shown in FIG. 2, the greenery covering 110 can cover the entire front surface 106 of the grazing wall 102 and may be in the form of a single layer 120 that may be attachable to a front surface of the main wall frame structure 122. In other embodiments, the greenery covering 110 may only cover a portion of the grazing wall 102 as desired by the user 102. The greenery covering 110 as shown in FIG. 1 may be positioned on the main frame wall structure 122 and each shelf 104 may attach through the greenery covering 110 to the main frame wall structure 122. Any means of attachment may be used to attach the shelves 104 to the main frame wall structure 122. For example, one or more brackets and fasteners may be used to attach the shelves 104 to the main frame wall structure 122. Alternatively, or additionally, nails or screws may be used to screw the shelves 104 into the main frame wall structure 122. Alternatively, or additionally, the shelves 104 may be magnetically attracted to the surface of the main frame wall structure 122 of the grazing wall 102 and one or more magnets (e.g., magnets 208 shown in FIG. 6A) may be used to hold the shelves 104 in place on a vertical front surface 106 of the grazing wall 102. The shelves 104 may be permanently attached to the front surface 106 of the main frame wall surface 122 of the grazing wall 102 or may be removably attachable.

Notably, the grazing wall 102 may be a type of presentation and display wall for containers 203 that can be reused multiple times. The grazing wall 102 can be stored as a whole unit that is not disassembled (e.g., as shown in FIG. 1 and FIG. 3) and/or may be disassembled for easy storage. The grazing wall 102 may be customized and personalized to include images, text, or other elements for any particular occasion or for any particular user. For example, the grazing wall 102 may include printed and/or engraved lettering for a particular person, family, business, or any other type of entity and may be reused on multiple occasions. The grazing wall 102 may be a keepsake or a sentimental item as well.

Figure 4:
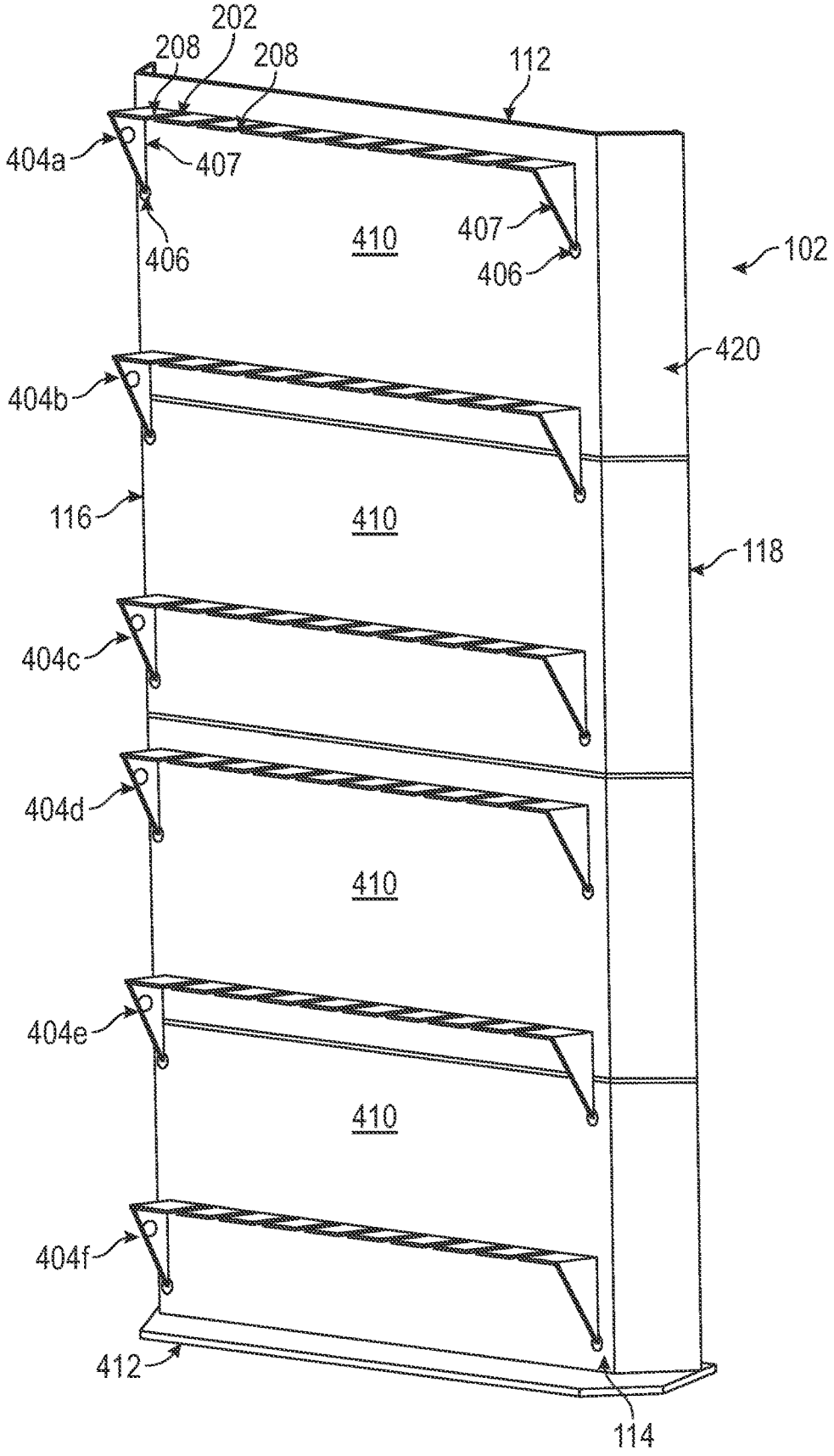
FIG. 4 is a pictorial illustration of a front side of a grazing wall having multiple shelves, cover panels, and a base.
Figure 5:
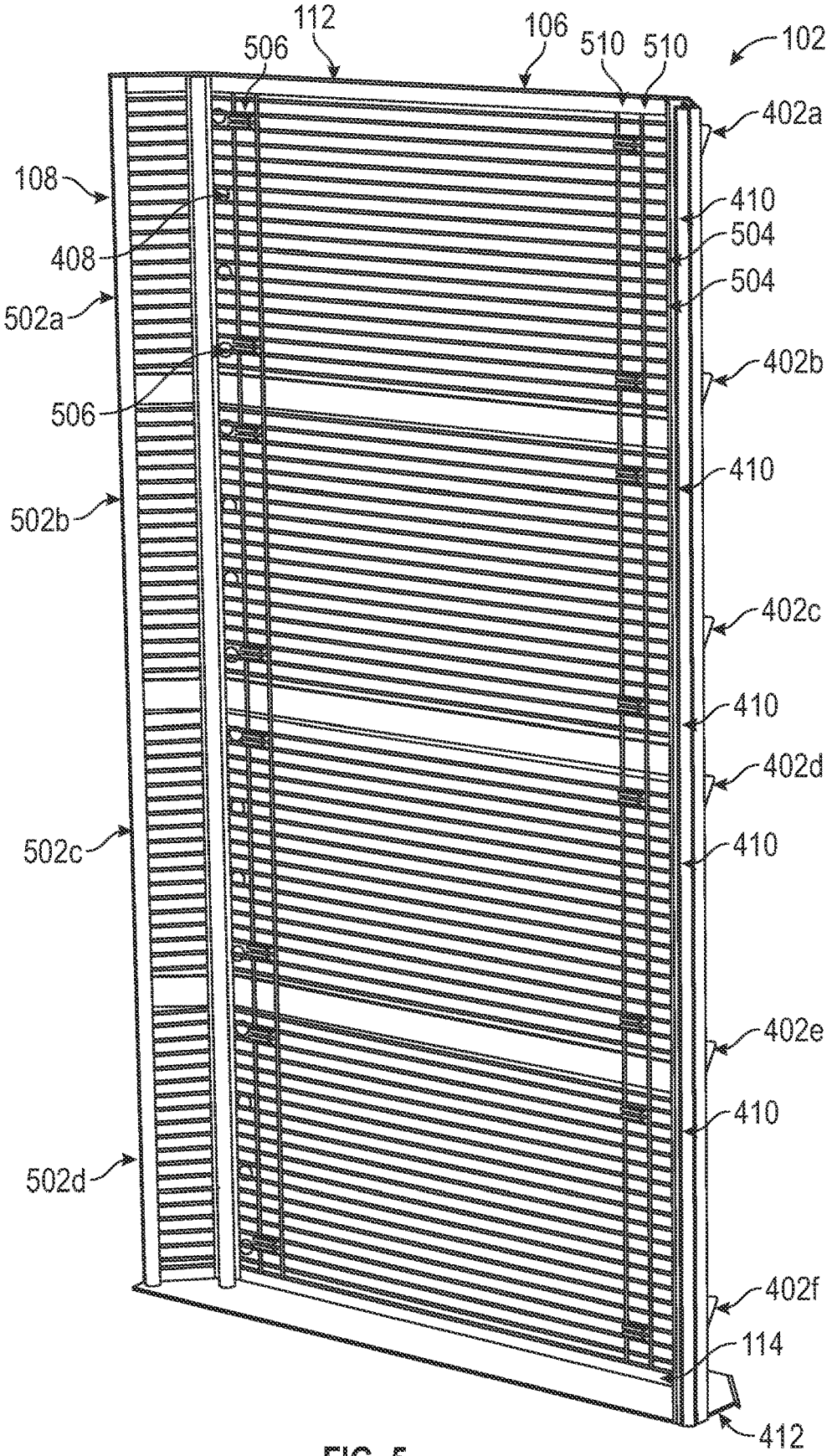
FIG. 5 is a pictorial illustration of a back side of the grazing wall that includes multiple back panels comprising horizontal and vertical grid bars.

FIGS. 4-12 show an exemplary embodiment of grazing wall 102. FIG. 6A shows an exploded view of the various components that make up grazing wall 102 as shown in FIGS. 4-12. The grazing wall 102 may thus be an assembly of layers or components (e.g., as shown in FIGS. 1-3 and FIGS. 4-12). As shown in FIG. 4, grazing wall 102 may be an assembly of cover panels 410, shelves 404, and a base unit 412 that connect to a set of back panel modules 502, which are shown in FIG. 5. The back panel modules 502 make up the main frame wall structure and the cover panels 410 are configured to be removably connected or attachable to the front side of the assembled set of back panel modules 502.

Figure 9:
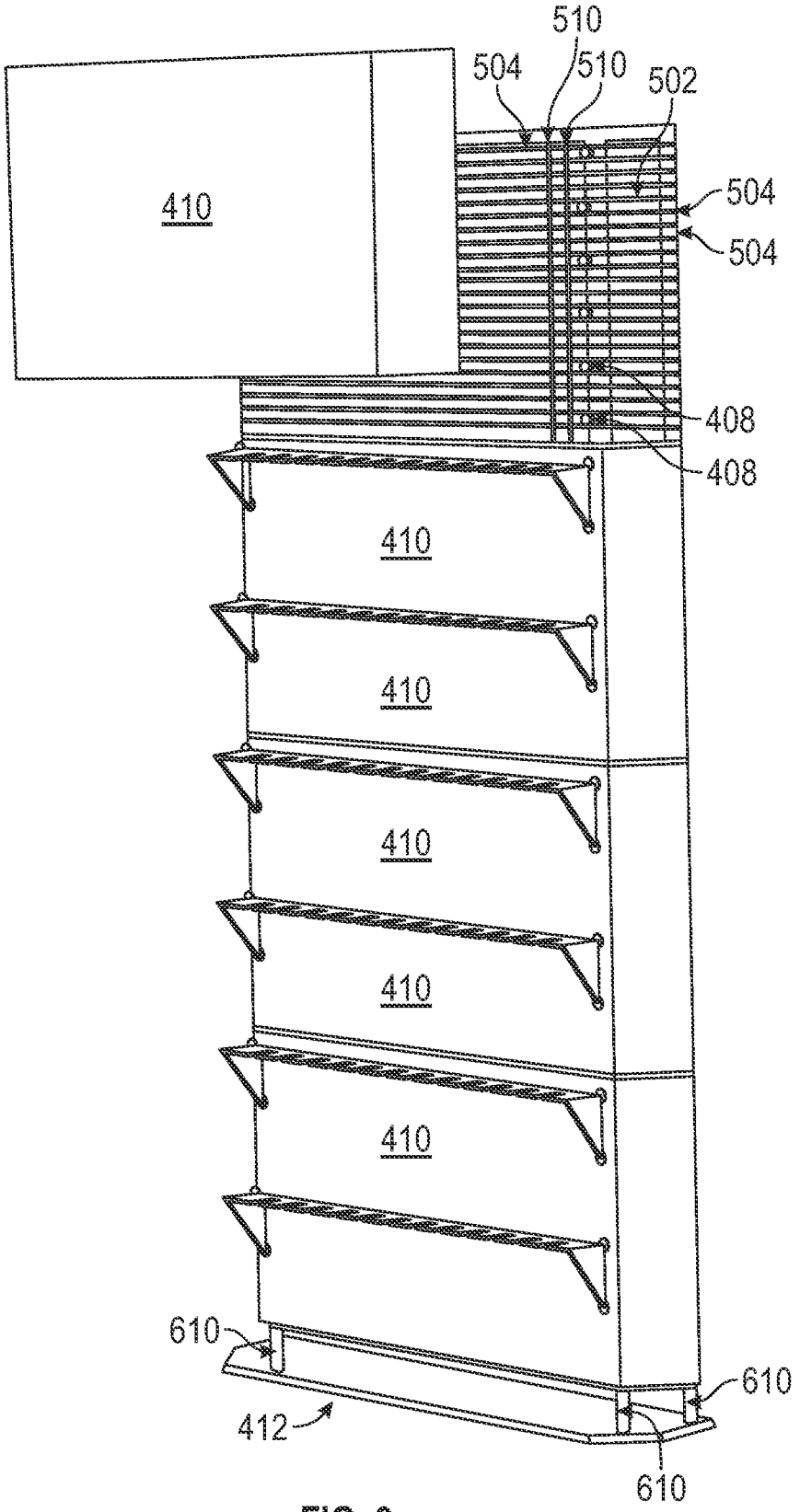
FIG. 9 is a pictorial illustration of a partial exploded view of the grazing wall.

The base unit 412 may be removably connected, in one or more non-limiting embodiments, to a bottom edge 114 of the lowermost cover panel 410 and/or back panel module 502, as shown in FIG. 5. One or more connector pieces 610, as shown in FIG. 6A and FIG. 9, may be utilized to connect the base unit 412 to the bottom edge 114 of the lowermost cover panel 410 and/or back panel module 502.

Figure 6A:
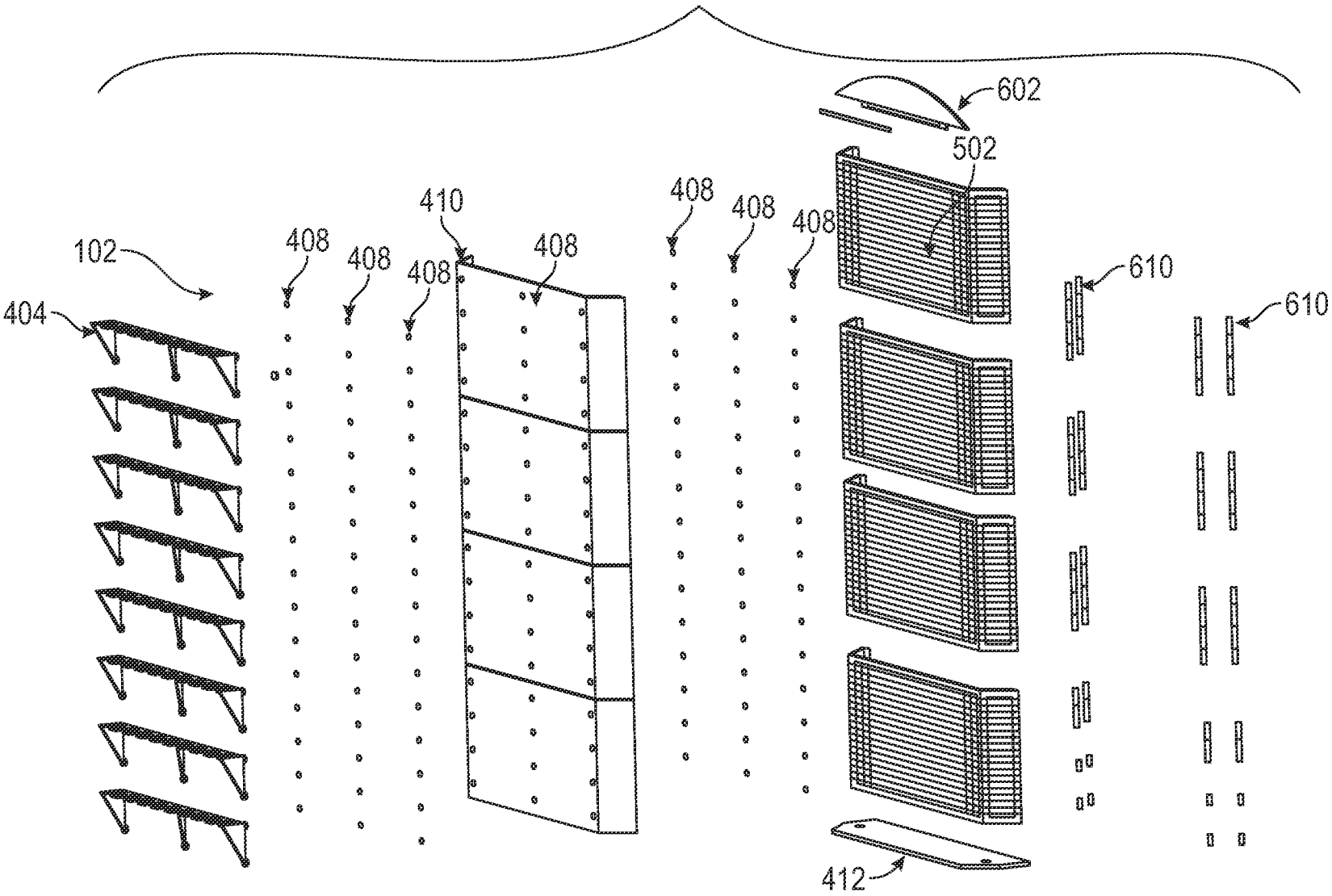
FIG. 6A is a pictorial illustration of an exploded view of the grazing wall shown in FIG. 4 and FIG. 5.

As shown in the exploded view shown in FIG. 6A, the grazing wall 102 may further include a top head piece 602 that may optionally connect to the uppermost back panel module 502 in addition to the bottom base piece 412. Text or images or greenery or other decorative elements may be included on either the top head piece 602, shown in FIG. 6A, and/or the base unit 412, shown in FIG. 4, FIGS. 6A-6C, and FIG. 9, in one or more non-limiting embodiments. The decorative elements may function to customize the grazing wall 102 to the event or occasion. The user can personalize the appearance of the grazing wall 102 for each event by including specific text, images, decorative elements on either the top head piece 602 or the base unit 412 that correspond to a specific purpose of an event or celebration or get together. For example, if the grazing wall 102 is utilized at a wedding, the top head piece 602 and/or base unit 412 may include the words "Congratulations" and names of the married couple as well as images or symbols of a wedding to further coordinate with the purpose and function of the event.

Figure 12:
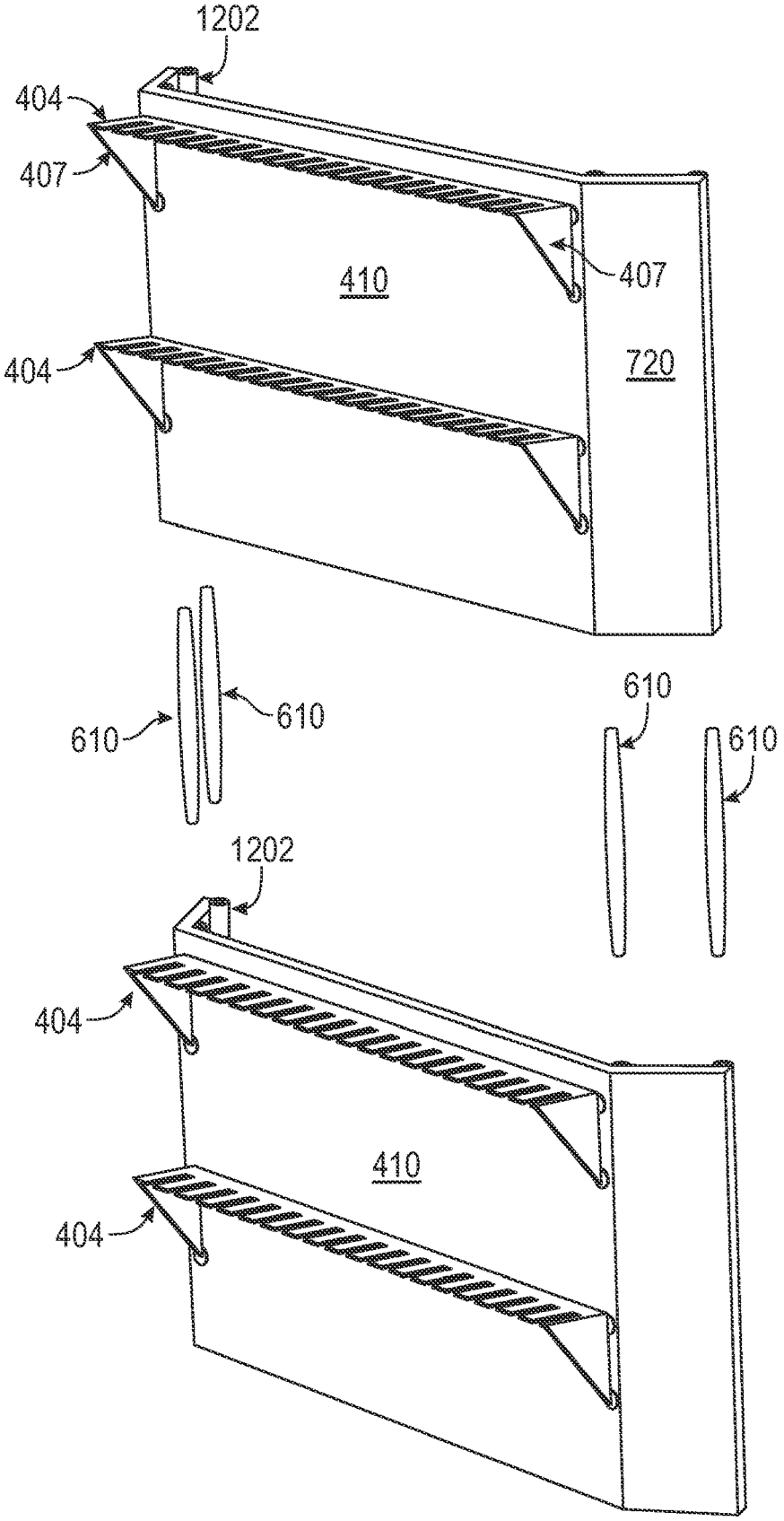
FIG. 12 is a pictorial illustration of an assembly of cover panels and shelves and connector pieces that can be used to assemble grazing walls to various heights.

As shown in FIG. 6A, the grazing wall 102 is an assembly of a set of shelves 404 that connect to the desired number and set of shelves 404 which in turn connect to the set of back panel modules 502. The back panel modules 502 may be configured to be stacked one on top of each other and be held in place by connectors 610 that can be inserted into one or more poles or rod units 1202, as shown in FIG. 12, incorporated or otherwise built into the back panel modules 502 in one or more non-limiting embodiments. Each back panel module 502 is connected in a vertical orientation with another back panel module 502 until a desired height for the grazing wall 102 is achieved. As noted above, with respect to the grazing wall 102 shown in FIGS. 1-3, the grazing wall 102 shown in FIGS. 4-12 can be customizable in terms of its height, whereby the user can assembly as many back panel modules 502 as desired until a desired height is achieved. The connectors 610 may be separate pieces that act as connection elements to insert in one or more rods or poles 1202 or to connect the back panel modules 502 together in a vertical orientation in one or more non-limiting embodiments.

Once the back panel modules 502 are connected in a vertical orientation, the user may then connect the cover panels 410 to the back panel modules 502 in a non-limiting embodiment. Subsequently, the user may attach the desired number of shelves 402 to the cover panels 410.

In a non-limiting embodiment, the shelves 404 and the cover panels 410 are magnetically attracted to the back panel modules 502. As shown in FIG. 6A, there may be a number of individual magnetic pieces 208 used to magnetically attach the shelves 404 to the cover panels 410 and to the back panel modules 502. The back panel modules 502 may be composed of material that makes the back panel modules 502 magnetically attracted to the magnetic pieces or elements 208. Accordingly, in a non-limiting embodiment, the back panel modules 502 may include metals or a combination of materials that are attracted to magnets, such as magnets 408.

As shown in FIG. 5 and FIG. 6A, each back panel module 502 may include a grid panel composed of an arrangement of horizontal grid bars 504 and vertical grid bars 510. Accordingly, in one or more non-limiting embodiments, the grid bars 504 and 510 of the back panel module 502 may be magnetically attracted to the magnets 408 utilized to removably connect the shelves 404 to the cover panels 410 and the cover panels to the back panel modules 502.

As shown in FIGS. 4-12, in a non-limiting embodiment, the side surfaces 420 of the grazing wall 102 may be angled so as to offer additional structural support to the grazing wall 102 when standing as a self-supporting upright structure on either a ground surface or other surface (including but not limited to a table surface or other elevated surface). The grazing wall 102 shown in FIGS. 4-12 may be free-standing and not require attachments to attach to a ground surface or other surface to be free-standing. In other embodiments, one or more fasteners, or other attachments means may be used to hold the grazing wall 102 against or to one or more ground or vertical surfaces.

Figure 6B:
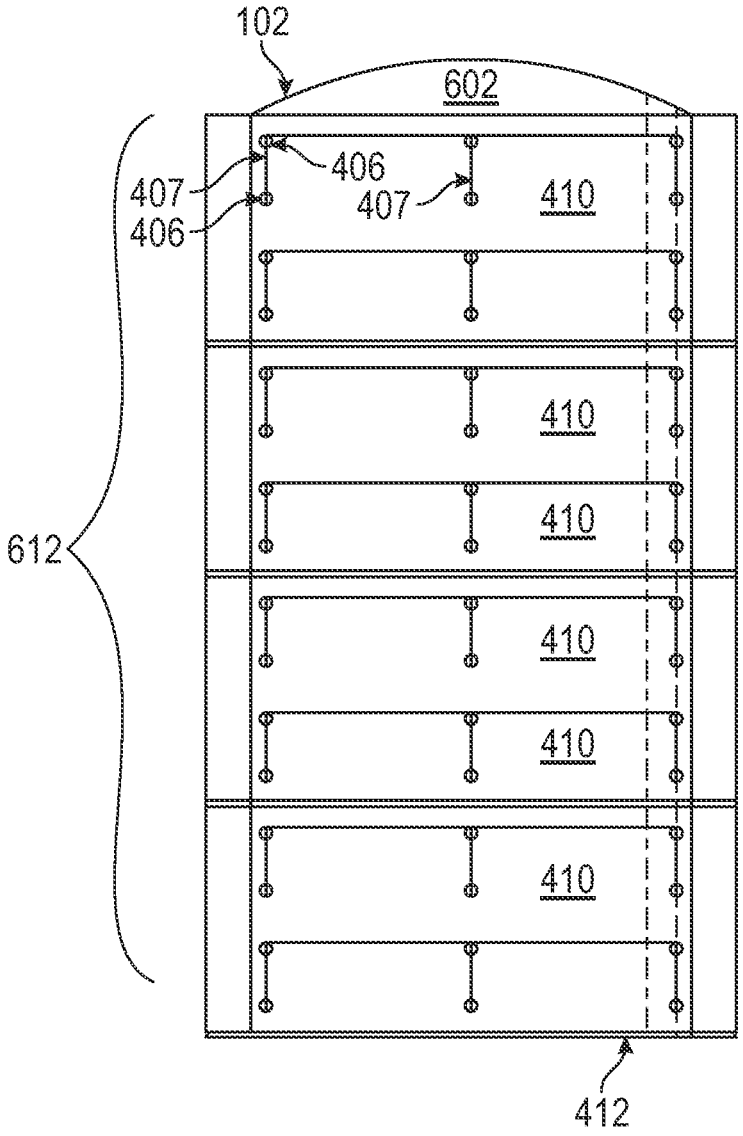
FIG. 6B is a pictorial illustration of a front side of the grazing all shown in FIG. 6A.
Figure 6C:
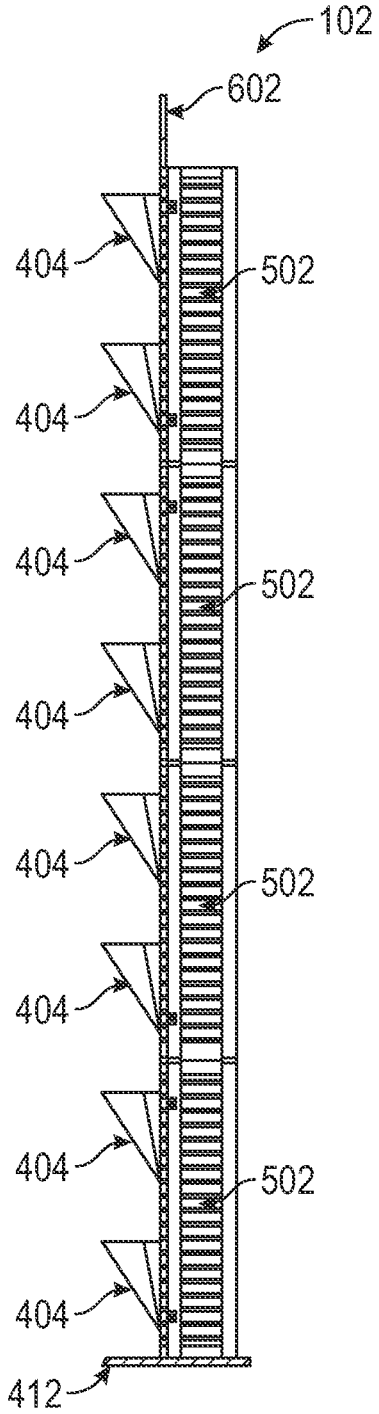
FIG. 6C is a pictorial illustration of a side view of the grazing wall shown in FIG. 6A.
Figure 6D:
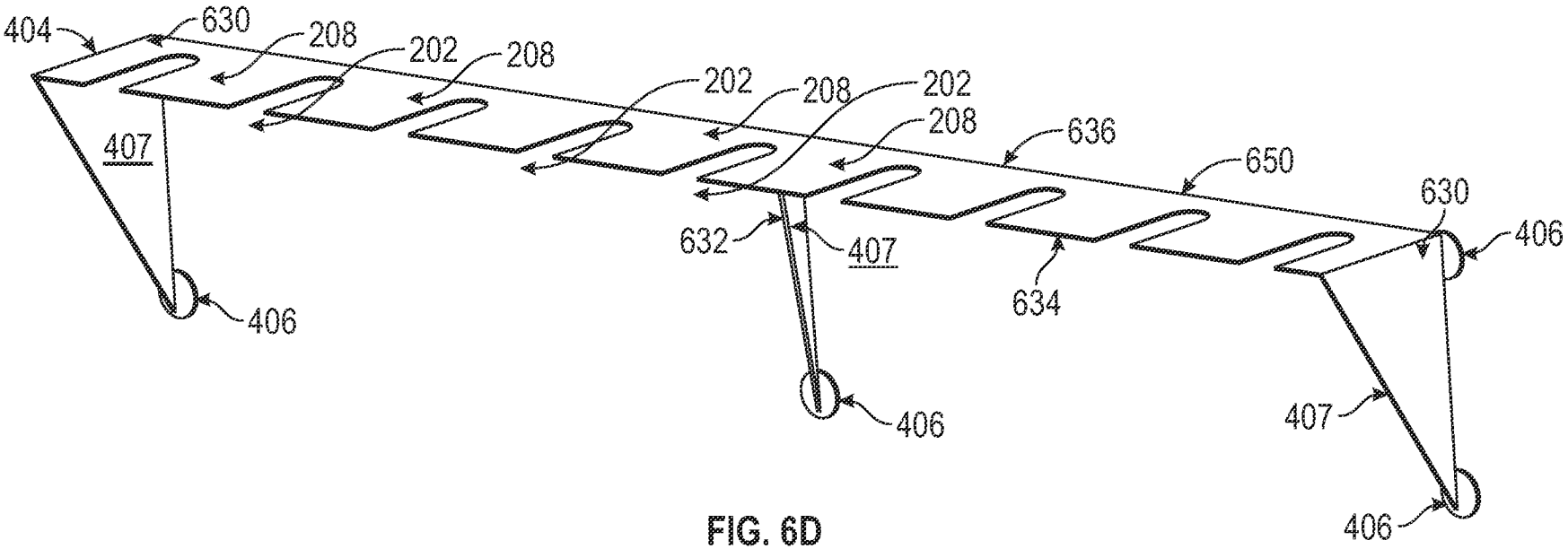
FIG. 6D is a pictorial illustration of an exemplary shelf for the grazing wall shown in FIG. 6A.

FIG. 4 and FIG. 6D display that the shelves 404 may include multiple dedicated slots 202 in between separate segments 208, in accordance with the shelves 104 shown in FIGS. 1-3. The multiple dedicated slots 202 may be dedicated to holding containers 203 of food and/or beverages (e.g., contents 206) as shown in FIGS. 1-3 in a non-limiting embodiment. The containers 203 may be in the form of cones 204 and/or drinking glasses 302 or any other type of container 203 in one or more non-limiting embodiment. The containers 203 may be included in the multiple slots 202 of the shelves 404 shown in FIGS. 4-12 and may allow the user to retrieve the container 203 full of pre-filled food and/or beverage from the grazing wall 102.

FIG. 4 and FIG. 6D depict that each individual shelf 404 may further include multiple bracket pieces 407 that may be used to temporarily or permanently attach the shelf 404 to the cover panel 410 and/or back panel module 502. As shown in FIG. 6C and FIG. 6D, the brackets 407 can be on either end 630 of the top portion of the shelf 404 and/or may be centrally positioned 632 and affixed to a back of the shelf 404. The brackets 407 may include dedicated magnet holders 406, as shown in FIG. 6D, that are configured to receive and hold one or more magnets 408 that fit within the magnet holders 406 of each bracket 407. As shown in FIG. 6D, in a non-limiting embodiment, the magnet holders 406 can be in the same shape as the shape of the magnet pieces 408 so that the magnet pieces 408 fit within the magnet holders 406. For example, as shown in FIG. 6A and FIG. 6D, the magnets 408 are circular shaped, so the magnet holders 406 of the brackets 407 of each shelf 404 are circular shaped as well. Any other shape other than circular may also be utilized in other non-limiting embodiments.

The shelves 404 or 104 may be easily mounted anywhere on the grazing wall 102, and/or on a respective cover panel 410. As shown in FIG. 4 and FIG. 6D, each slot 202 may be formed into a body of a planar portion 650 of the shelf 404. Accordingly, the shelf 404 may include a planar portion 650 that is horizontally oriented and that includes multiple slots 202 separated from each other by separate segments 208 as shown in FIG. 6D. The containers 203 of food and/or drinks (e.g., contents 206 as shown in FIGS. 2-3) may be removably fitted within each slot 202 of each shelf 404 whereby a bottom portion 214 (e.g., as shown in FIGS. 2-3) of the container 203 extends beneath the slot 202 of each shelf 404 and a majority of the body 212 sits above the slot 202 in between each segment 208 and the open end 210 of the containers 203 reveals the contents 206 of the container 203.

The slots 202 may be carved into the planar portion 650 of the shelves 404 such that the slot 202 is open on a front side but does not extend all the way to a back edge of the planar portion 650, as shown in FIG. 6D. Accordingly, the slot 202 is partially extending through a body of the planar portion 650 of the shelf 404. Each bracket 407 can attach to an underside of the planar portion 650 and extend below the planar portion 650 of each shelf 404. In a non-limiting embodiment, each bracket 407 serves as a structural element to stabilize the shelf 404 when positioned on the grazing wall 102. Further, the bracket 407 may function to cause the shelf 404 to protrude away from the front surface of the grazing wall 102 (e.g., and/or away from the cover panel 410 shown in FIGS. 4-12) so that the containers 203 that would be positioned in each slot 202 of the shelves 404 is positioned in front of and not flush with a front surface of the grazing wall 102.

FIG. 4 and FIG. 9 shows that the shelves 404 may be stacked vertically with enough distance between each shelf so that the containers 203 can be displayed hanging in a vertical orientation as fitted within each slot 202 of each shelf 404 without having the containers 203 be crowded or interfere with each other's position in either a horizontal or vertical direction. The separators 208 on each shelf 404 that separate each slot 202 may further act to have each container 203 stand apart and fit comfortably within each designated slot 202 on the grazing wall 102.

FIG. 6C shows that the grazing wall 102 is an assembly of the grid panel modules 502 stacked vertically on top of each other and connected via one or more connector pieces 610 (e.g., as shown in FIG. 6A and FIG. 12). The cover panels 410 may be positioned over each respective grid panel module 502 and then a desired number of shelves 404 attached as well, as shown in FIG. 6C.

Figure 7:
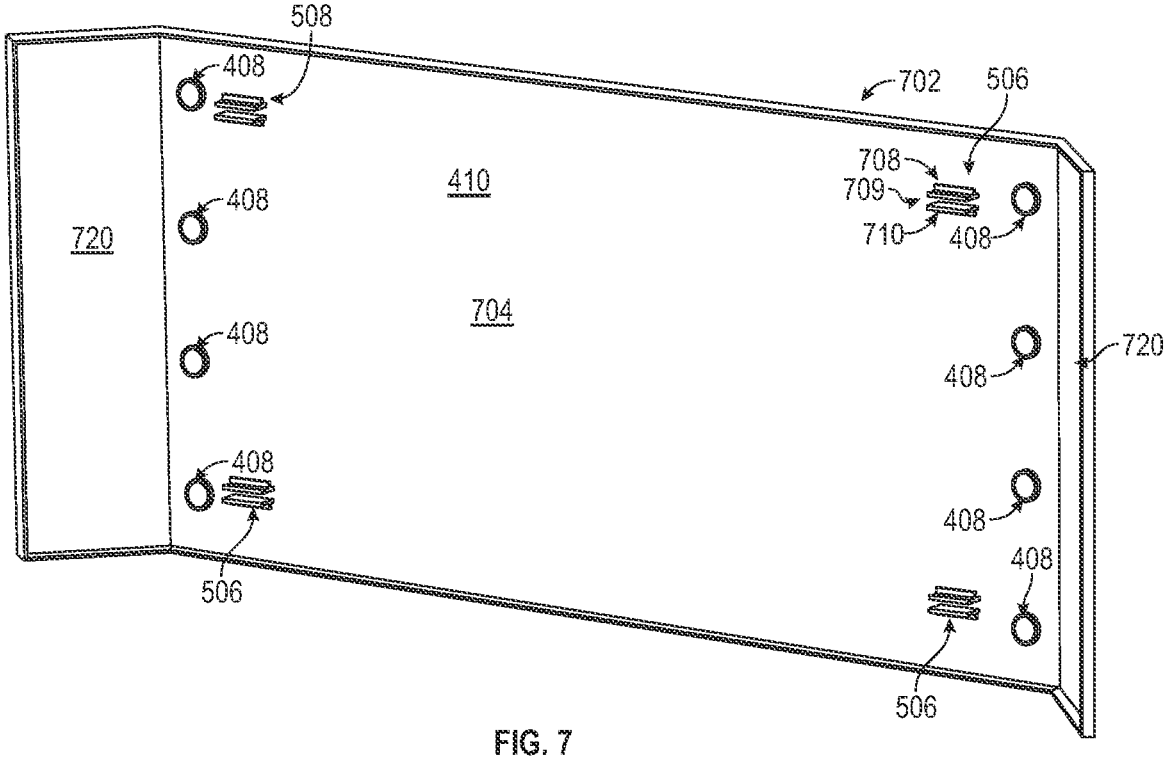
FIG. 7 is a pictorial illustration of a back view of a cover panel.
Figure 8:
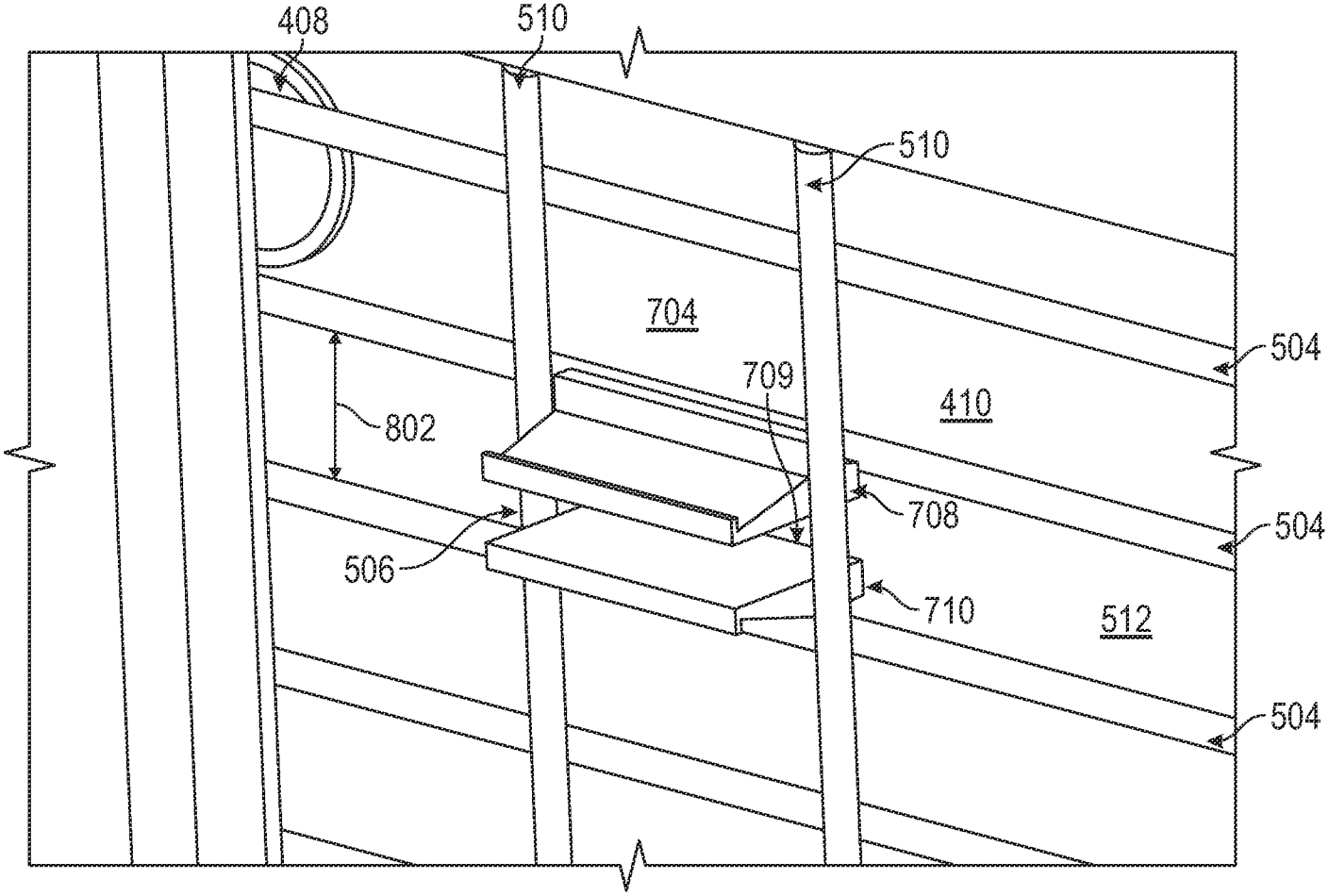
FIG. 8 is a pictorial illustration depicting a clip from a back of a cover panel inserted in between bars of a grid panel of the grazing wall.
Figure 10:
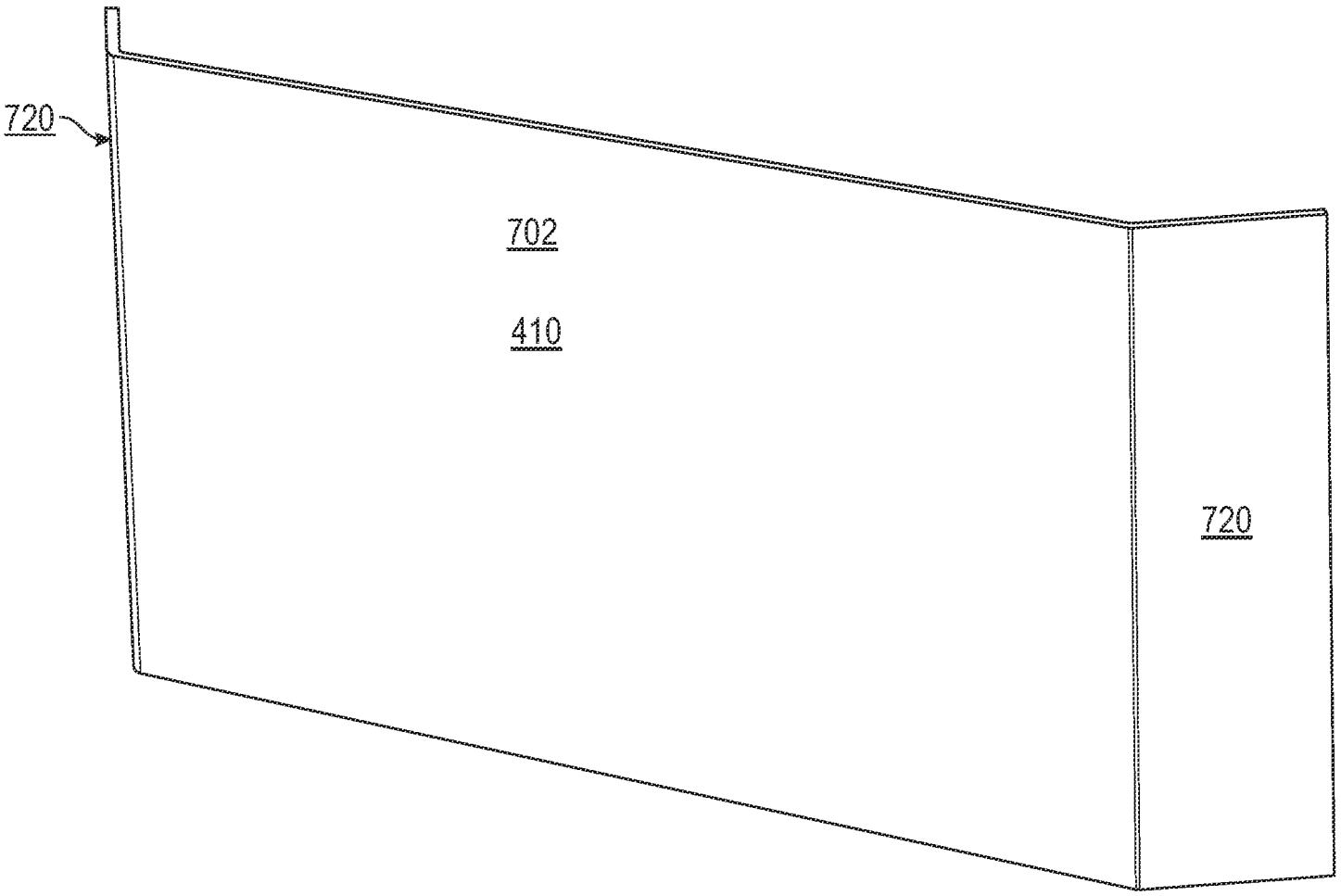
FIG. 10 is a pictorial illustration of a front view of a cover panel.

FIGS. 7-10 provide additional details about the cover panels 410 according to one or more non-limiting embodiment. FIG. 7 provides a close-up view of an example of a back side surface of a cover panel 410. FIG. 8 provides a close-up view of one or more clips 506 positioned on a back side 704 of the cover panel 410 inserted into an opening 512 of the grid panel. FIG. 9 provides a close-up view of several cover panels 410 removably connected to several back panel modules 502. FIG. 10 depicts a front view of a cover panel 410 according to a non-limiting embodiment. FIG. 11 provides exemplary greenery 1102 that may be integrated with or attachable to a front surface 702 of a cover panel 410 to provide a green and nature-oriented cover panel 410 and look to the grazing wall 102.

As shown in FIGS. 7-10, in one or more non-limiting embodiments, each cover panel 410 may have a width and height that corresponds to a width and height of each back panel module 502 such that each cover panel 410 is generally the exact same size as each back panel module 502. The cover panel 410 has a more decorative appearance than the back panel module 502 and provides a visually appealing cover for grazing wall 102. In one or more non-limiting embodiments, a cover panel 410 may have a solid color or finish on its front surface 702 as shown in FIG. 7 and FIG. 10. For example, the cover panel 410 may have a faux marble appearance in one non-limiting embodiment. In other embodiments, the cover panel 410 may have a design with a logo for a company. In other embodiments, the cover panel 410 may be a set of horizontal or vertical stripes. In various embodiments, there may be various printed images and/or patterns and/or text displayed on a front surface 702 of the one or more cover panels 410 to provide the desired visual external appearance seen by guests and other viewers of the grazing wall 102. Other decorative elements such as flowers, beads, jewels, glitter, photos or images may be a part of a front 702 of each cover panel 410. In a non-limiting embodiment, as shown in FIG. 11, the cover panels 410 may include greenery 1102 that include a series of leaves 1102 and/or vines 1104.

Any type of greenery or natural elements taken from or inspired by nature, such as, but not limited to, moss, stones, vines, leaves, flowers, fruits, vegetables, or any other type of natural element may be included or be a part of each cover panel 410 so that the grazing wall 102 has such a decorative appearance that includes greenery 1102. These decorative elements, including the greenery or other hanging decor 1102 shown in its exemplary form in FIG. 11, may be artificial and made of synthetic materials and/or may incorporate real elements, such as real flowers, leaves, sticks, etc. These decorative elements, which may include any kind of hanging decor, may be pre-affixed or provided with each cover panel 410 upon purchasing or providing the cover panel 410 to the user to use to assemble the grazing wall 102.

FIG. 7 shows that there may be one or more clips 506 positioned in designated positions on a back surface 704 of each cover panel 410. The one or more clips 506 are further shown in FIG. 5, whereby FIG. 5 shows a back view of a completed grazing wall 102 with a number of cover panels 410 removably affixed or attached to an equal number of grid panel back panel modules 502.

The clips 506 may be designed to fit within designated spaces or openings 512 between each horizontal grid line 504 of the grid panel back module 502, as shown in FIG. 8. Further, the clips 506 may also fit within spaces or openings 512 in between one or more vertical grid lines 510 of the grid panels 502 as well as the horizontal grid lines 504. The clips 506 may include a top portion 708 and a bottom portion 710 with a space 709 in between the top portion 708 and the bottom portion 710. In a non-limiting embodiment, the clips 506 may act as spring clips, whereby a user may press the top portion 708 and the bottom portion 710 together and insert them into the openings 512 of the grid panel back modules 502 whereby the clips 506 press back out again and stay in place within the openings 512 of the grip panel back modules 502 until a force is applied again (e.g., by the fingers of the user) to withdraw or remove the clips 506 and the cover panel 410 from the grid panel back modules 502. The clips 506 may be sized to fit a height 802 of each horizontal space or opening 512 in the grid panel back module 502.

As shown in FIG. 7, the cover panel 410 may come with a number of such clips 506 already attached to the back side 704 of each cover panel 410. As shown in FIG. 7, there may be at least four clips 506 positioned on each corner of the cover panel 410, although a greater or lesser number of clips 506 may alternatively be used. Further, included on a rear side 704 of each cover panel 410 may be magnetic holders 406 (similar to those shown on the brackets 407) and/or magnetic elements 408. The magnetic elements 408 for the cover panels 410 may be affixed and held in place in their designated positions on the back of the cover panels 410. Accordingly, in a non-limiting embodiment, there may be more than one means of attaching the cover panels 410 to the back panel modules 502. For example, as noted above, the clips 506 may be insertable within their designated spaces 512 of the back panel modules 502. Additionally, or alternatively, the magnets 408 may magnetically attach to the front side of the grid panel back panel modules 502 as well, thereby holding the cover panel 410 against each respective back panel module 502.

Accordingly, the user may determine a number of back panel modules 502 needed to achieve a desired height 612 as shown in FIG. 6B for the grazing wall 102, and connect the requisite number of back panel modules 502. Subsequently, the user may place one or more magnets 408 in their respective holders 406 or the cover panels 410 may already include pre-attached, pre-affixed magnets 408 on a back side 704 of each cover panel 410. The cover panels 410 may then be pushed or otherwise manipulated onto and against each respective back panel module 502 in order for the cover panel 410 to cover a front side of the back panel module 502. Accordingly, the grazing wall 102 may be built or ordered with built-in segments of back panel modules 502 to achieve a desired height and a corresponding number of cover panels 410.

Next, the user may position one or more shelves on a front side of each cover panel 410. As shown in FIG. 6A, and throughout the FIGS. 4-12, the shelves 404 may be magnetically attracted to the cover panel 410, which includes a set of magnets 408 on the back side 704 of the cover panels 410, whereby the cover panels 410 are magnetically attracted to the back panel modules 502. Further, the shelves 404 may be positioned having different distances from each other or having a same distance from each other in a vertical direction. The shelves 404 may be situated to best suit avoiding interference between the containers 203 so that one container 203 is not touching a container 203 stored on a shelf 404 above the bottom container 203. Alternatively, the shelves 404 may be stacked to be closer to eye level or to a shorter height of a user so as not to be out of reach of most heights of users or guests. Accordingly, the position of the shelves 404 on the grazing wall 102 may be determined to accommodate a variety of needs.

Other means of attachment of the shelves 404 and the cover panels 410 onto the back panel modules 502 are also contemplated herein. For example, a number of removable fasteners, such as, but not limited to, screws or similar type fasteners may be used to fasten the shelves 404 to the cover panels 410 and to the back panel modules 502. Any other type of attachment may alternatively be used. Further, it is noted that in other non-limiting embodiments, the shelves 404 may not be separately removable from the cover panels 410. Rather, the shelves 404 may be permanently affixed to the front side 702 of the cover panels 410, and the user may position each cover panel 410 with each fixed shelf 404 to the back panel module 502 to form a desired height of the grazing wall 102.

Notably, the grazing wall 102 in any of the Figures may be segmented into components and may be stackable to a desired height. Further, the grazing wall 102 may be stowed in a smaller format or smaller stature or in its individual components to be more storage friendly and take up less space. In other embodiments, the grazing wall 102 may be a single unit that is not capable of being disassembled.

In a non-limiting embodiment, the grazing wall 102 may be assembled from an assembly of back panel modules 502 that may be stacked side by side to form a vertical structure such as a grazing wall 102. In other embodiments, the grazing wall 102 may comprise a corner and post assembly, with a tri-fold lattice cover panel. The shelves may resemble the shelves 104 and 404 shown in FIGS. 1-3 and FIGS. 4-9. There may be a weighted base unit and the system may be disassembled as needed.

Accordingly, the present description provides for various embodiments for an exemplary grazing wall that holds multiple containers 203 of food and drink and/or other items in a decorative and pleasing way on a dedicated wall space. Each container 203 is displayed in an easy to access slot 202 on a shelf 104 or 404 of a grazing wall 102. The grazing wall 102 may be placed on a ground surface, as shown in FIGS. 1-2 or may be placed on a table or other elevated surface, as shown in FIG. 3. The grazing wall 102 can be an assembly of layers and levels, and the height and/or width of the grazing wall 102 may be customized. The grazing wall 102 may include a decorative, visually appealing appearance via the use of decorative cover panels 410 and/or greenery 1102 in one or more non-limiting embodiments. Many additional advantages and uses are offered by the one or more systems described herein.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention.

The embodiments were chosen and described in order to best explain the principles of the invention and the practical application, and to enable others of ordinary skill in the art to understand the invention for various embodiments with various modifications as are suited to the particular use contemplated. The present invention according to one or more embodiments described in the present description may be practiced with modification and alteration within the spirit and scope of the appended claims. Thus, the description is to be regarded as illustrative instead of restrictive of the present invention.

What is claimed is:

1. A grazing wall, comprising:

an assembly of layers, the assembly further comprising:

a set of back panels;

a set of cover panels configured to removably attach to a front side of the set of back panels, wherein each cover panel covers each back panel of the set of back panels positioned behind each cover panel such that a width and a height of each cover panel is the same as a width and a height of each back panel, and wherein the set of back panels are configured to be vertically stackable to a customizable height one over another and the set of cover panels cover each back panel up to the customizable height, wherein each cover panel is selectable from the set of cover panels having a desired aesthetic appearance; and a set of shelves configured to removably attach to a front side of the set of cover panels, wherein the set of shelves further comprises a set of multiple slots, wherein the set of multiple slots are spaced apart from each slot of the set of multiple slots and separated by separate segments in between each slot of the set of multiple slots, and wherein the set of multiple slots are configured to hold containers for food or drinks.

2. The grazing wall of claim 1, wherein the set of back panels comprise a set of grid panels.

3. The grazing wall of claim 2, wherein each grid panel of the set of grid panels is modular and further comprises horizontal grid bars and vertical grid bars.

4. The grazing wall of claim 3, wherein each cover panel of the set of cover panels comprise a front side and a back side, the front side including the desired decorative appearance and the back side of each cover panel of the set of cover panels including attachment mechanisms to attach each cover panel of the set of cover panels to each grid panel of the set of grid panels.

5. The grazing wall of claim 4, wherein each grid panel of the set of grid panels comprises horizontal grid bars and vertical grid bars.

6. The grazing wall of claim 1, wherein the set of containers are positioned in front of the grazing wall.

7. The grazing wall of claim 1, wherein the set of shelves is magnetically connectable to the set of cover panels.

8. The grazing wall of claim 1, wherein the set of cover panels are magnetically connectable to the set of back panels.

9. The grazing wall of claim 1, wherein the customizable height of the grazing wall is determined by a same number of the set of back panels and the set of cover panels connected vertically to each other, wherein the customizable height of the grazing wall is alterable depending on the number of the set of back panels and the set of cover panels that are connected vertically to each other.

10. The grazing wall of claim 1, wherein the containers include non-edible items instead of the food or the drinks or in addition to the food or the drinks.

11. The grazing wall of claim 1, wherein the desired aesthetic appearance is on a front surface of the set of cover panels and comprises colors, prints, text, or faux finishes or appearances.

12. The grazing wall of claim 1, wherein the grazing wall further comprises hanging decor that is configured to drape over or to be attached to one or more cover panels of the set of cover panels.

13. The grazing wall of claim 12, wherein the hanging decor comprises greenery with aspects of nature or green plants or flowers.

14. The grazing wall of claim 1, further comprising a detachable base piece, wherein a first back panel of the set of back panels is configured to attach to the detachable base piece and offer structural support to the grazing wall.

15. The grazing wall of claim 1, further comprising a top finishing piece that is configured to attach to an uppermost back panel of the set of back panels of the grazing wall.

16. The grazing wall of claim 1, wherein each back panel comprises a center segment and a left side and a right side, wherein the left side and right side are angled at an acute or obtuse angle from the center segment.

17. The grazing wall of claim 1, wherein each cover panel comprises a center segment and a left side and a right side, wherein the left side and right side are angled at an acute or obtuse angle from the center segment.

18. A grazing wall, comprising:

an assembly of layers, the assembly further comprising:

a set of back panels, wherein the set of back panels comprise a set of grid panels, wherein each grid panel of the set of grid panels is modular and further comprises horizontal grid bars and vertical grid bars;

a set of cover panels configured to removably attach to a front side of the set of back panels, wherein each cover panel covers each back panel of the set of back panels positioned behind each cover panel such that a width and a height of each cover panel is the same as a width and a height of each back panel, and wherein the set of back panels are configured to be vertically stackable to a customizable height one over another and the set of cover panels cover each back panel up to the customizable height, wherein each cover panel is selectable from the set of cover panels having a desired aesthetic appearance, wherein the set of cover panels are attachable with attachment mechanisms that clip onto the horizontal or vertical grid bars of each grid panel; and a set of shelves configured to removably attach to a front side of the set of cover panels, wherein the set of shelves further comprises a set of multiple slots, wherein the set of multiple slots are spaced apart from each slot of the set of multiple slots and separated by separate segments in between each slot of the set of multiple slots, and wherein the set of multiple slots are configured to hold containers for food or drinks.

19. The grazing wall of claim 18, further comprising hanging decor that extends over all or a portion of the set of cover panels.

20. The grazing wall of claim 18, further comprising a set of feet or a base to offer structural support to hold the grazing wall upright.

* * * * *